US006169806B1

(12) United States Patent
Kimura et al.

(10) Patent No.: US 6,169,806 B1
(45) Date of Patent: Jan. 2, 2001

(54) COMPUTER, COMPUTER SYSTEM AND DESK-TOP THEATER SYSTEM

(75) Inventors: Shinta Kimura; Yasuo Sato, both of Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 08/795,725

(22) Filed: Feb. 4, 1997

(30) Foreign Application Priority Data

Sep. 12, 1996 (JP) ..... 8-241700

(51) Int. Cl.[7] ..... H04R 5/00

(52) U.S. Cl. ..... 381/17; 381/18; 381/300; 381/307; 381/310

(58) Field of Search ..... 381/1, 5, 17–19, 381/24, 63, 61–62, 300, 302, 307, 304, 310

(56) References Cited

U.S. PATENT DOCUMENTS 5,524,053 * 6/1996 Iwamatsu ..... 381/18
5,530,762 * 6/1996 Jones et al. ..... 381/63
5,553,149 * 9/1996 Freadman ..... 381/306
5,588,063 * 12/1996 Edgar ..... 381/24
5,630,175 * 5/1997 Gajewski et al. ..... 381/18
5,642,422 * 6/1997 Hon et al. ..... 381/19
5,742,688 * 4/1998 Ogawa et al. ..... 381/17

FOREIGN PATENT DOCUMENTS 52-024501 2/1977 (JP) .
53-149424 12/1978 (JP) .
55-026763 2/1980 (JP) .

OTHER PUBLICATIONS

Allen, loan "Matching the Sound to the Picture ," *AES 9th International Conference*, pp. 177–186.

* cited by examiner

*Primary Examiner*—Duc Nguyen
(74) *Attorney, Agent, or Firm*—Staas & Halsey LLP

(57) ABSTRACT

A computer including an extraction unit for extracting source signals of surround sound from data received via a medium, and a processor for decoding and converting the source signals into audio signals of a plurality of channels. The processor includes the function of correction a sound field of a plurality of speakers which are arranged approximately concentrically together with a display unit about an operating position of a user operating the computer.

44 Claims, 16 Drawing Sheets

COMPUTER, COMPUTER SYSTEM AND DESK-TOP THEATER SYSTEM

BACKGROUND OF THE INVENTION

The present invention generally relates to computers, computer systems and desk-top theater systems, and more particularly to a computer, computer system and desk-top theater system which can realize at home, for example, with relative ease, a surround sound system approximating a sound system of a movie theater.

The sound system of the movie theater can reproduce powerful sound with a high presence, and there are demands to realize sound with such a high presence at home or the like.

Conventionally, a home theater system was proposed to reproduce sound having a high presence similar to that realized by sound system of a movie theater. The proposed home theater system includes an audio visual system set up within a listening room at home, a plurality of speakers connected to the audio visual system, and a television monitor. The audio visual system displays on the television monitor a video signal which is reproduced from a video disk, for example, and also supplies to the speakers audio signals which are reproduced from the video disk so as to realize surround sound. In this speaker, each of the speakers are arranged with respect to the television monitor and a listener with a positional relationship which is essentially the same as that employed by the sound system of the movie theater.

According to the proposed home theater system, it is possible to reproduce sound with a high presence which is very similar to that obtained by the sound system of the movie theater.

However, the proposed home theater system is basically the same as setting up a small-scale movie theater at home, and a listening room exclusively for the home theater system must be provided at home. For this reason, there was a problem in that it is impossible to set up the home theater system at home when there is no extra room or space available, such as in a small house or apartment located at the center of the city, for example.

In addition, in order to enjoy the surround sound, there were problems in that furniture or the like cannot be arranged freely within the listening room and materials used for the walls and ceiling become limited to a certain extent when reflections of sound within the listening room are taken into consideration.

Furthermore, in order to enjoy powerful surround sound at home, sound-proofing or noise-proofing must be provided for the listening room so as not to disturb people in other rooms of the house or neighbors, and there was also a problem in that the home theater system as a whole is expensive.

SUMMARY OF THE INVENTION

Accordingly, it is a general object of the present invention to provide a computer, computer system and desk-top theater system in which the problems described above are eliminated.

Another and more specific object of the present invention is to provide a computer, a computer system and desk-top theater system which can realize surround sound with a high presence even within a limited space at home, for example, without the need to provide expensive equipment, and without the need to greatly consider the reflections of sound.

Still another object of the present invention is to provide a computer comprising extraction means for extracting source signals of surround sound from data received via a medium, and processing means for decoding and converting the source signals a audio signals of a plurality of channels. According to the computer of the present invention, it is possible to realize surround sound with a high presence even within a limited space at home, for example, without the need to provide expensive equipment, and without the need to greatly consider the reflections of sound.

A further object of the present invention is to provide a computer comprising extraction means for extracting source signals of surround sound from data received via a medium, and processing means for decoding and converting the source signals into audio signals of a plurality of channels, whereby the processing means includes correction means for correcting a sound field of a plurality of speakers which are arranged approximately concentrically together with a display unit about an operating position of a user operating the computer. According to the computer of the present invention, it is possible to realize surround sound with a high presence even within a limited space at home, for example, without the need to provide expensive equipment, and without the need to greatly consider the reflections of sound.

Another object of the present invention is to provide a computer comprising a main computer body, a display unit coupled to the main computer body, and a plurality of speakers arranged approximately concentrically together with the display unit about an operating position of a user operating the computer, whereby the main computer body comprises extracting means for extracting a video source signal to be displayed on the display unit and source signals of surround sound from data received via a medium, and processing means for decoding and converting the surround sound source signals into audio signals of a plurality of channels. According to the computer of the present invention, it is possible to realize surround sound with a high presence even within a limited space at home, for example, without the need to provide expensive equipment, and without the need to greatly consider the reflections of sound.

Still another object of the present invention is to provide a computer system comprising a main computer body including at least a central processing until and a display unit coupled to the main computer body, whereby the main computer body comprises extracting means for extracting source signals of surround sound from data received via a medium and processing means for decoding and converting the source signals into audio signals of a plurality of channels. The processing means includes correction means for correcting a sound field of a plurality of speakers arranged approximately concentrically together with the display unit about an operating position of a user operating the computer system. According to the computer system of the present invention, it is possible to realize surround sound with a high presence even within a limited space at home, for example, without the need to provide expensive equipment, and without the need to greatly consider the reflections of sound.

A further object of the present invention is to provide a desk-top theater system comprising a computer system having a main computer body including at least a central processing unit and a display unit coupled to the main computer body, and a plurality of speakers arranged approximately concentrically together with the display unit about an operating position of a user operating the computer system, whereby the main computer body comprises extracting means for extracting a video source signal to be displayed on the display unit and source signals of surround sound from data received via a medium, and processing means for decoding and converting the surround sound source signals into audio signals of a plurality of channels. According to the desk-top theater system of the present invention, it is possible to realize surround sound with a high presence even within a limited space at home, for example, without the need to provide expensive equipment, and without the need to greatly consider the reflections of sound.

Other objects and further features of the present invention will be apparent from the following detailed description when read in conjunction with the accompanying drawings.

DESCRIPTION OF THE PREFERRED EMBODIMENTS

A computer and computer system according to the present invention are characterized in that an audio signal processing system is provided to reproduce surround sound. In addition, the computer system and desk-top theater system according to the present invention are characterized in that an audio signal processing system is provided to process audio signals so that surround sound with a high presence can be realized even within a limited space at home, for example.

According the computer and computer system of the present invention, the surround sound can be reproduced in a relatively simple manner using a personal computer or the like. For example, it is possible to enjoy the surround sound while playing a recording medium such as a video disk or a CD-ROM which stores game software.

In addition, according to the computer system and desk-top theater system of the present invention, it is possible to realize the surround sound with a high presence in a relatively simple manner, even within the limited space at home, without the need for expensive equipment.

First, a description will be given of a first embodiment of the computer system according to the present invention. In this first embodiment of the computer system, the present invention is applied to a personal computer. In addition, this first embodiment of the computer system is applied to a first embodiment of the desk-top theater system according to the present invention.

Figure 1:
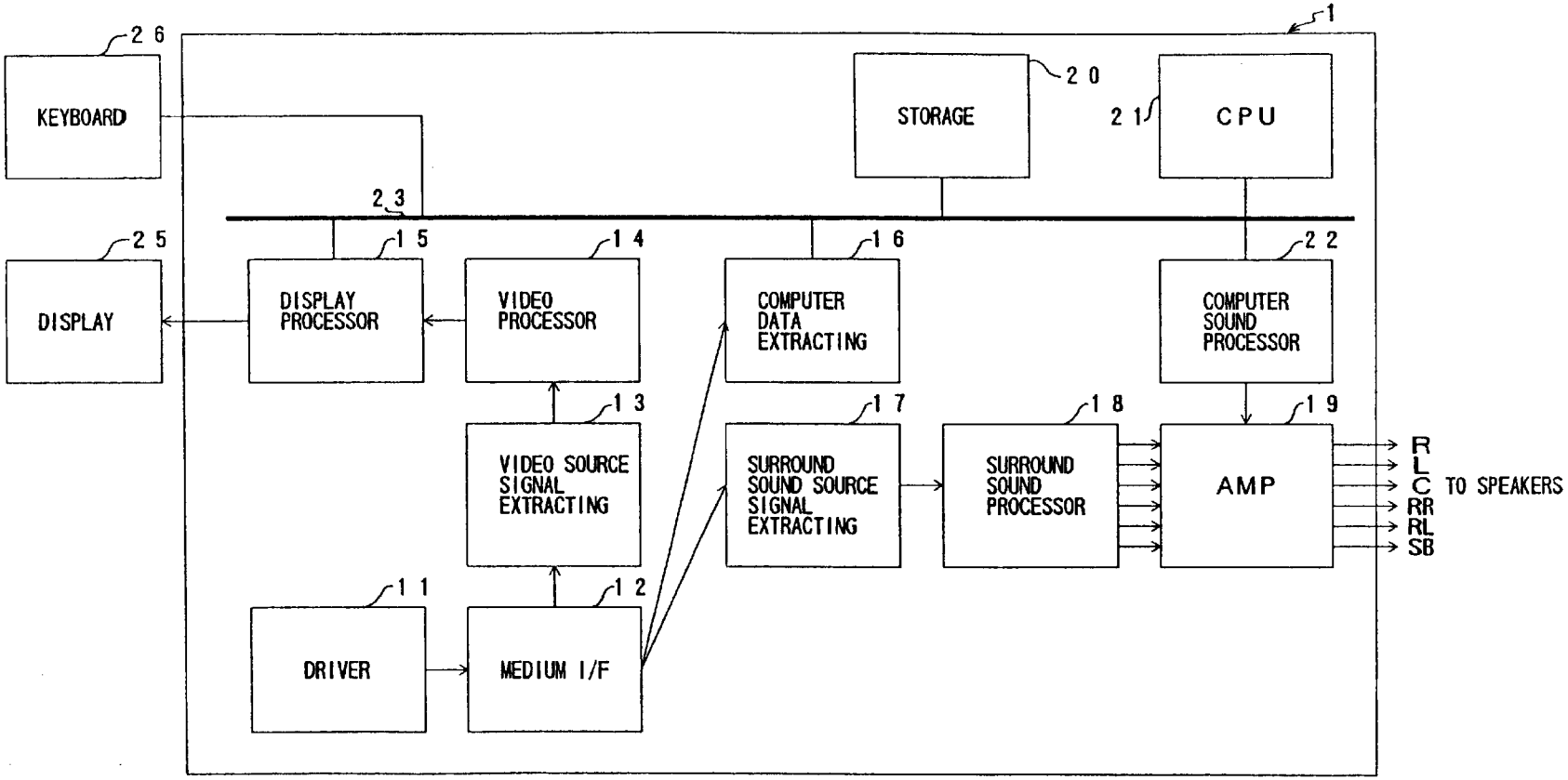
FIG. 1 is a system block diagram showing the construction of a part of a first embodiment of a computer system according to the present invention.

FIG. 1 is a system block diagram showing the construction of a part of the first embodiment of the computer system. In FIG. 1, a personal computer includes a main computer body 1 and a display unit 25. The computer body 1 includes a recording medium driver 11 which is capable of at least reproducing information from a recording medium, a medium interface 12, a video source signal extracting unit 13, a video processor 14, a display processor 15, a personal computer data extracting unit 16, a surround sound source signal extracting unit 17, a surround sound processor 18, an amplifier 19, a storage unit 20, a central processing unit (CPU) 21, a personal computer sound processor 22, and a personal computer bus 23 which are connected as shown.

A known apparatus which reproduces information from a recording medium (not shown) that may be a magnetic disk such as a floppy disk, a CD-ROM, an optical disk, a magneto-optic disk, a digital video disk or the like may be used for the recording medium driver 11. In this case, the known apparatus used for the recording medium driver 11 may also have the function of recording information on the recording medium.

The personal computer bus 23 couples the display processor 15, the personal computer data extracting unit 16, the storage unit 20, the CPU 21 and the personal computer sound processor 22.

The display unit 25 is coupled to the display processor 15 of the main computer body 1. In addition, a keyboard 26 is connected to the personal computer bus 23 of the main computer body 1. It is possible to connect a pointing device (not shown) such as a mouse to the personal computer bus 23 in addition to the keyboard 26.

Reproduced data that are reproduced from the recording medium by the recording medium driver 11 are supplied to the medium interface 12 wherein various signals are reproduced. The video source signal extracting unit 13 extracts a video source signal from the reproduced data received via the medium interface 12, and supplies the video source signal to the video processor 14. The video processor 14 converts the video source signal into a video signal to be displayed on the display unit 25. The display processor 15 converts the video signal into a signal having a signal format which is suited for display on the display unit 25 under the control of the CPU 21, and supplies the signal having the converted signal format to the display unit 25.

The personal computer data extracting unit 16 extracts the personal computer data from the reproduced data received via the medium interface 12, and supplies the extracted data to the CPU 21 via the personal computer bus 23. Accordingly, when synthesizing the personal computer data and the video signal and displaying the synthesized signal on the display unit 25, for example, the personal computer data are supplied to the display processor 15 via the personal computer bus 23 under the control of the CPU 21. In this case, the display processor 15 synthesizes the personal computer data and the video signal from the video processor 14, and supplies the synthesized signal to the display until 25 so as to display a synthesized image. The surround sound source signal extracting unit 17 extracts a surround sound source signal from the reproduced data received via the medium interface 12, and supplies the surround sound source signal to the surround sound processor 18. The surround sound processor 18 decodes the surround sound source signal from the surround sound source signal extracting unit 17 into audio signals which are to be supplied to a plurality of speakers R, L, C, RR, RL and SB which will be described later. The plurality of channels of audio signals which are obtained by this decoding are amplified in the amplifier 19 before being supplied to the corresponding speakers R, L, C, RR, RL and SB.

The storage unit 20 stores various data and programs which are executed by the CPU 21 based on information input from the keyboard 26. The personal computer sound processor 22 carries out a surround sound process with respect to audio data generated from the CPU 21 or audio data based on the personal computer data from the personal computer data extracting unit 16, and outputs a plurality of channels of audio signals. The plurality of channels of audio signals output from the personal computer sound processor 22 are also amplified in the amplifier 19 before being supplied to the corresponding speakers R, L, C, RR, RL and SB.

A decoder having a known construction may be used for the video processor 14, and the video processor 14 may employ a digital system such as the MPEG-1 or MPEG-2 system.

On the other hand, a decoder having a known construction may be used for the surround sound processor 18, and the surround sound processor 18 may employ an analog system such as the Dolby pro logic system or a digital system such as the AC-3 system. In this embodiment, it is assumed for the sake of convenience that the surround sound processor 18 employs the AC-3 system.

In this embodiment, the medium interface 12, the video source signal extracting unit 13, the video processor 14, the display processor 15, the personal computer data extracting unit 16, the surround sound source signal extracting unit 17, the surround sound processor 18 and the amplifier 19 form a single integrated circuit (IC) unit.

Figure 2:
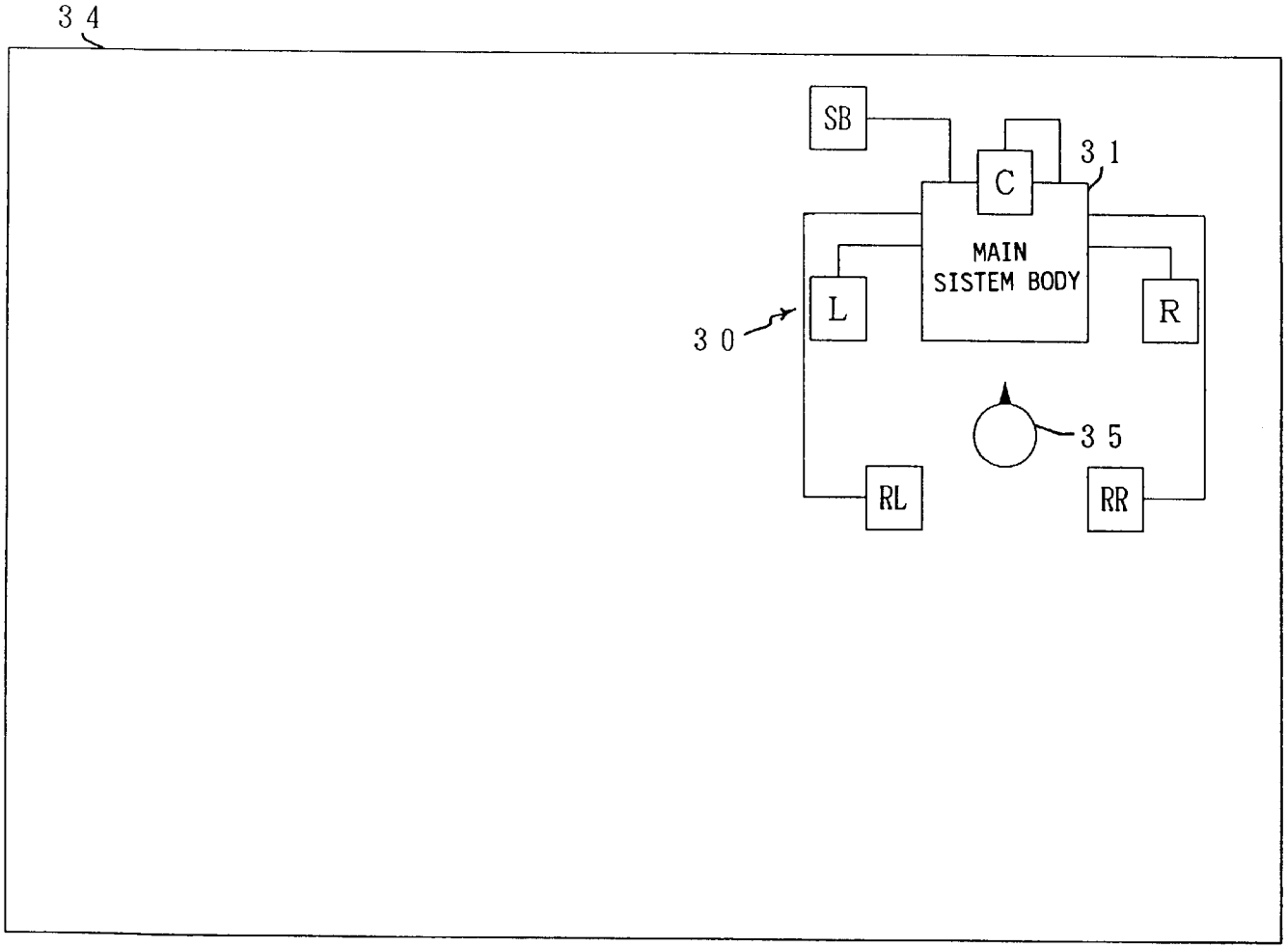
FIG. 2 is a diagram showing the general construction of a first embodiment of a desk-top theater system according to the present invention.

FIG. 2 is a diagram showing the general construction of a first embodiment of the desk-top theater system according to the present invention. In FIG. 2, a desk-top theater system 30 does not occupy a room 34 in its entirety, and only occupies a portion of the room 34. In this embodiment, the desk-top theater system 30 occupies a rear right corner portion of the room 34 in FIG. 2.

The desk-top theater system 30 includes a main system body 31, and the speakers R, L, C, RR, RL and SB. The main system body 31 includes the main computer body 1, the display unit 25 and the keyboard 25 shown in FIG. 1. Since the surround sound processor 18 employs the AC-3 system in this embodiment, the six speakers R, L, C, RR, RL and SB are arranged as shown in FIG. 2 with respect to the display unit 25 of the main system body 31 and a listener (user) 35. The front left speaker L, the rear left speaker RL, the rear right speaker RR, the front right speaker R and the center speaker C are used to reproduce the direction of the sound image and the sound field at the position of the listener 35. The sub woofer SB is used to reproduce particularly powerful bass. Since the bass has no directionality, only one sub woofer SB is used. The display unit 25 of the main system body 31 is arranged in front of the listener 35 and at a center of the front right speaker R and the front left speaker L.

The listener 35 sits at an operating position approximately in front of the display unit 25 so that it is possible to operate the keyboard 26, similar to the case where a normal personal computer system is operated. In other words, the display unit 25 of the personal computer is used in place of a television monitor. Hence, distances separating the listener 35, the display unit 25 and the speakers R, L, C, RR, RL and SB are relatively short, and extremely short when compared to those of the home theater system or the like. For this reason, the sound from each of the speakers R, L, C, RR, RL and SB can sufficiently reach the listener 35 even when the volume is relatively low.

According to this embodiment, it is unnecessary to prepare a large listening room exclusively for the theater system, and the listener 35 can enjoy powerful sound with a high presence, that is, surround sound, at a relatively low volume. In addition, since the desk-top theater system 30 uses the personal computer system 1, the listener 35 can operate the desk-top theater system 30 with a high flexibility using the various functions of the personal computer. Further, since the surround sound is reproduced at a relatively low volume, it is possible to reduce the reflections of the sound from the walls, furniture or the like that would otherwise deteriorate reproduction of the sound field. In other words, sufficiently satisfactory surround sound can be reproduced without taking into consideration the reflections of the sound. Moreover, because the surround sound is reproduced at a relatively low volume, it is unnecessary to provide sound-proofing or noise-proofing with respect to the room 34, and high-quality surround sound can be enjoyed easily at a low cost.

Figure 3:
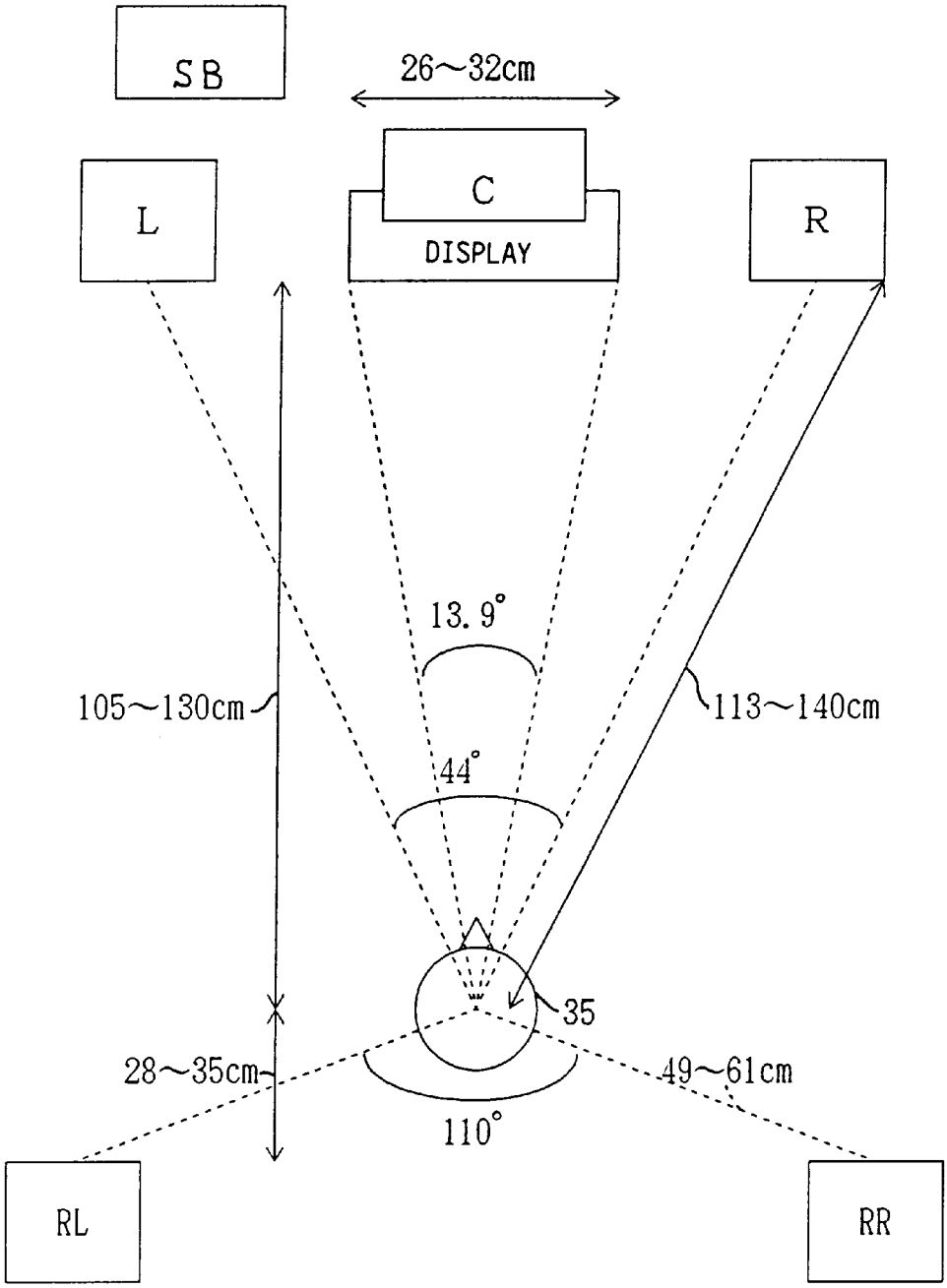
FIG. 3 is a diagram for explaining a positional relationship of a listener, a display unit and speakers suited for reproducing surround sound.

The positional relationship of the listener, the display unit and each of the speakers suited for the reproduction of surround sound is proposed in loan Allen, "Matching the Sound to the Picture", AES 9th International Conference, pp. 177–186, for example. By referring to the positional relationship proposed by loan Allen, the positional relationship of the listener 35, the display unit 25 and the speakers R, L, C, RR, RL and SB in this embodiment becomes as shown in FIG. 3. In FIG. 3, those parts which are the same as those corresponding parts in FIGS. 1 and 2 are designated by the same reference numerals, and a description thereof will be omitted.

Generally, the display unit 25 of the personal computer includes a display with a 14 inch to 17 inch screen, and thus, horizontal width of the display unit 25 is approximately 26 to 32 cm. As shown in FIG. 3, when the right and left speakers R and L are arranged on both sides of the display unit 25, an optimum distance between the display unit 25 and the listener 35 is approximately 105 to 130 cm, since it is regarded that the best angle of visual field of the screen of the display unit 25 is approximately 13.9°. In addition, it is regarded desirable that the separation angle of the rear right and left speakers RR and RL with respect to the listener 35 is approximately 110°, and that the listener 35 is located at a position which is approximately 73% of the distance from the front right and left speakers R and L to the rear right and left speakers RR and RL. Hence, an optimum distance between the rear right and left speakers RR and RL is approximately 66 to 88 cm. Therefore, the ideal arrangement of the listener 35, the display unit 25 and the speakers R, L, C, RR, RL and SB is as shown in FIG. 3.

Figure 4:
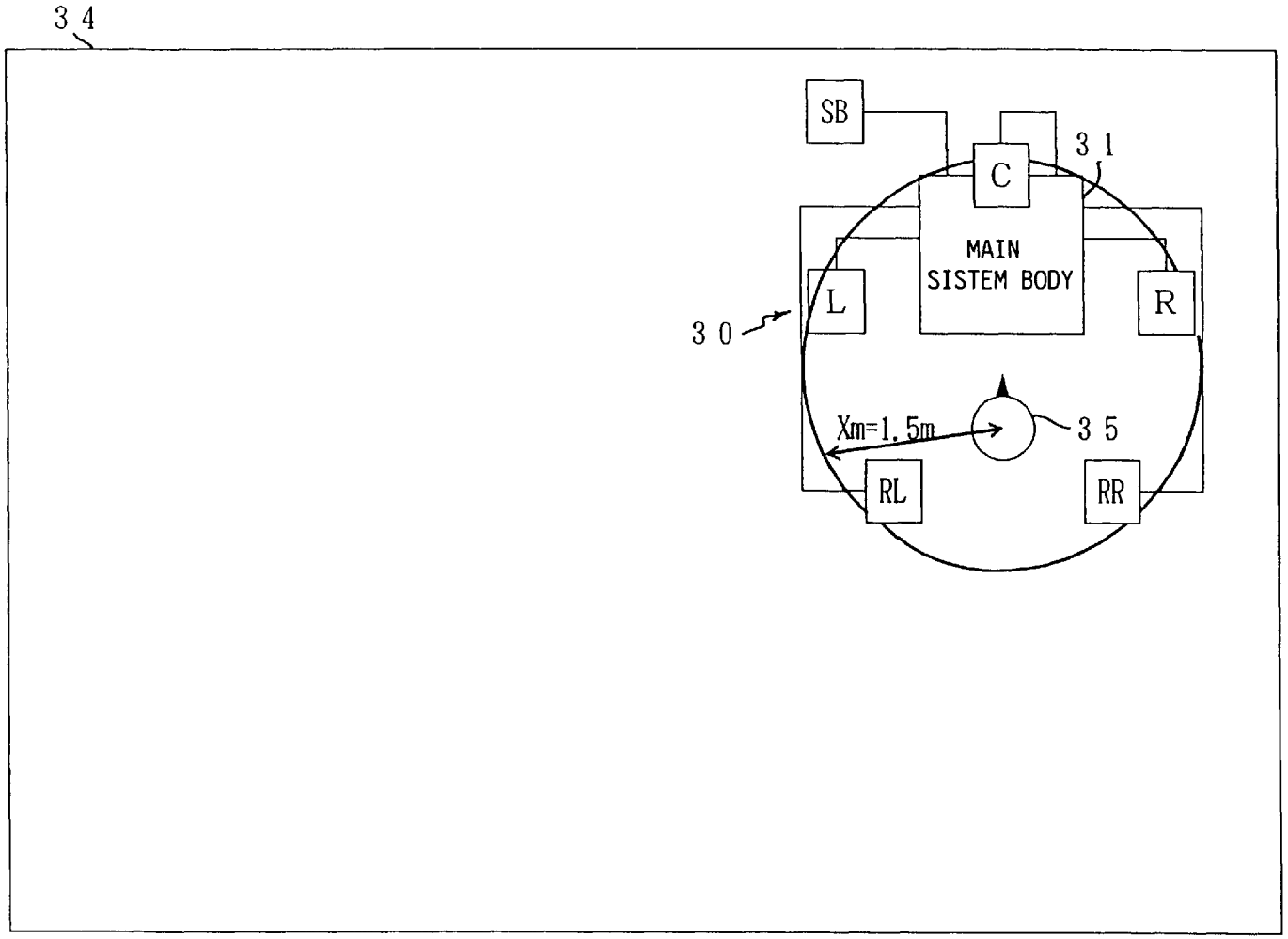
FIG. 4 is a diagram showing the general construction of a modification of the first embodiment of the desk-top theater system.

Although it is desirable to strictly employ the ideal arrangement shown in FIG. 3, such a strict arrangement is unsuitable when the listener 35 wishes to easily enjoy the surround sound. Hence, in a modification of the first embodiment of the desk-top theater system, each of the speakers R, L, C, RR and RL, excluding the sub woofer SB, and the display unit 25 are arranged as shown in FIG. 4. In FIG. 4, the speakers R, L, C, RR and RL and the display unit 25 are all arranged approximately concentrically at a radius of approximately 1.5 m about the listener 35. Even when such a simple speaker arrangement shown in FIG. 4 is employed, it is still possible to realize satisfactory surround sound from the practical point of view. Since the sub woofer SB reproduces the bass having no directionality, it is unnecessary to arrange the sub woofer SB at a specific position within the room 34. In this modification, the sub woofer SB is arranged at the rear left of the display unit 25, similar to the first embodiment.

When the horizontal width of the display unit 25 is approximately 26 to 32 cm, it is possible to obtain substantially the same effects as the above described by arranging all of the speakers R, L, C, RR and RL and the display unit 25 approximately concentrically at a radius of approximately 1.0 to 1.5 m about the listener 35.

Next, a description will be given of second through fourth embodiments of the computer system according to the present invention. In the second through fourth embodiments of the computer system, the present invention is applied to a personal computer. In addition, the second through fourth embodiments of the computer system are respectively applied to second through fourth embodiments of the desk-top theater system according to the present invention.

Figure 5:
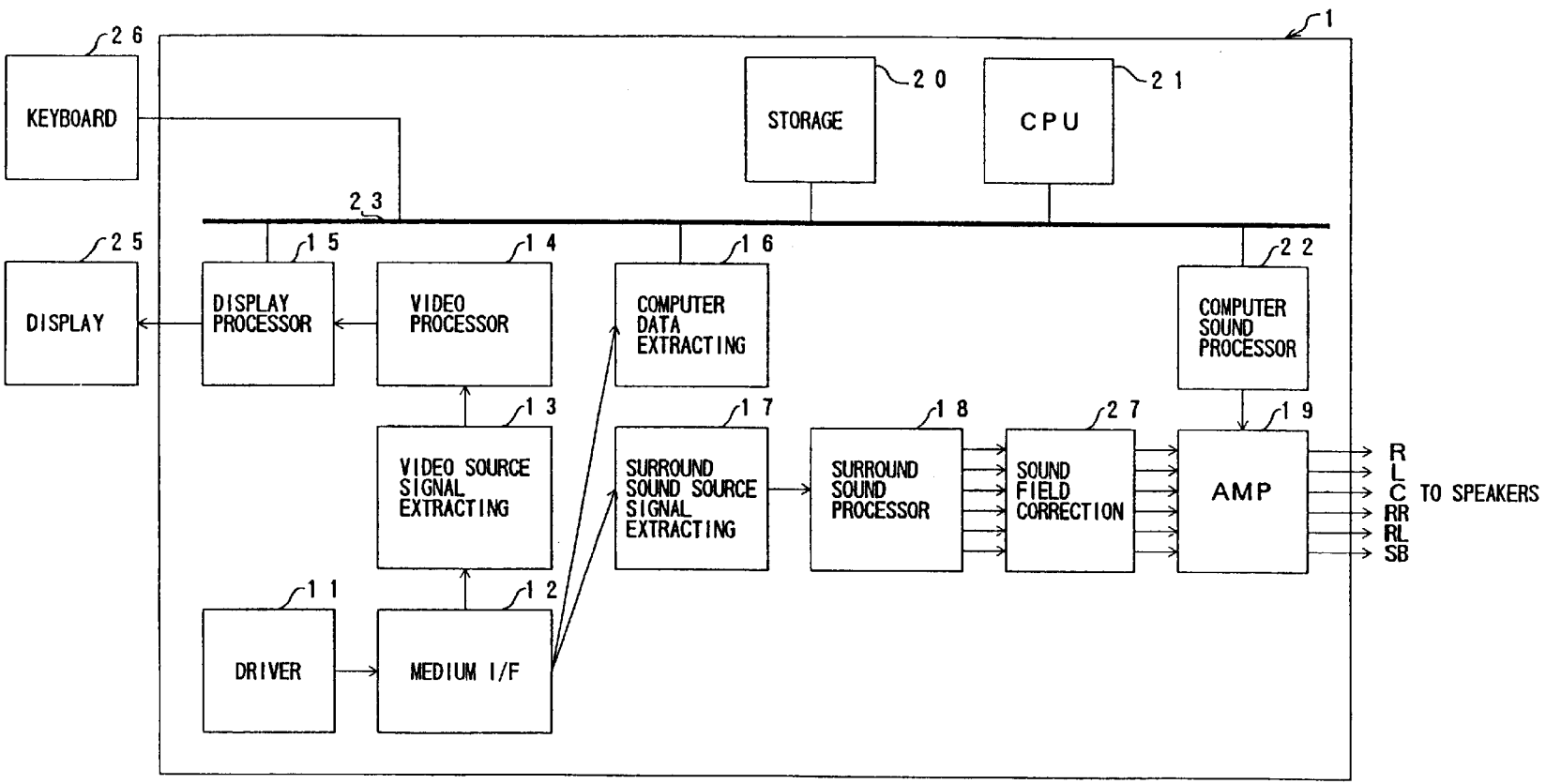
FIG. 5 is a system block diagram showing the construction of a part of second through fourth embodiments of the computer system according to the present invention.

FIG. 5 is a system block diagram showing the construction of a part of the second through fourth embodiments of the computer system. In FIG. 5, those parts which are the same as those corresponding parts in FIG. 1 are designated by the same reference numerals, and a description thereof will be omitted. As shown in FIG. 5, the second through fourth embodiments of the computer system are additionally provided with a sound field correction unit 27 between the surround sound processor 18 and the amplifier 19. Other parts of the second through fourth embodiments of the computer system are the same as those of the first embodiment of the computer system described above. The sound field correction unit 27 is provided to correct effects on the sound field caused by the speakers R, L, C, RR, RL and SB which are arranged relatively close to the listener 35.

In the second embodiment of the computer system and the second embodiment of the desk-top theater system, the sound field correction unit 27 includes volume correction means.

If is assumed for the sake of convenience that the volume setting of the general home theater system is made under the assumption that the listener will listen at a position approximately 3 m from the speakers, this volume setting would be too high for the desk-top theater system 30 when a distance Xm between the listener 35 and each of the speakers R, L, C, RR and RL is approximately 1.5 m or less as shown in FIG. 4. Hence, in this second embodiment, the volume from the speakers R, L, C, RR, RL and SB is corrected to suit the desk-top theater system 30.

The amplitude of sound is inversely proportional to the distance. Hence, when reproducing sound in the desk-top theater system 30 in which the distance Xm is approximately 1m, the audio signals which are processed similar to the home theater system having a volume setting such that the distance between the listener and the speakers is assumed to be approximately 3 m, the amplitudes of the audio signals are corrected to approximately ⅓ times. Thus, when the received audio signals have been processed similar to the home theater system having a volume setting such that the distance between the listener and the speakers is assumed to be approximately 3 m, the sound field correction unit 27 corrects the gains of the audio signals of each of the channels to approximately ⅓ times using an attenuator, for example, so as to correct the volume. As a result, the audio signals of the corresponding channels are reproduced from the speakers R, L, C, RR, RL and SB at a volume that is suited for the arrangement of the listener 35 and each of the speakers R, L, C, RR, RL and SB within the desk-top theater system 30.

The circuit itself for correcting the gain as described above is known. For this reason, illustration and description related to the gain correcting circuit will be omitted.

In the third embodiment of the computer system and the third embodiment of the desk-top theater system, the sound field correction unit 27 includes means for correcting differences in frequency characteristics caused by different distances separating each of the speakers and the walls of the room.

In the home theater system, the distance between each speaker and the listening room wall is shorter than the distance between the listener and each speaker. In this case, the bass region is emphasized due to the baffle effect of the speakers caused by the walls. Generally, the speakers are designed to have an approximately flat characteristic by taking into account this baffle effect.

However, in the case of the desk-top theater system 30, the volume from each speaker is low, and the above described baffle effect disappears if the distance between the listener and each speaker is shorter than the distance between each speaker and the room wall. For this reason, the intensity of the bass region will be considerably low if a normal amplifier and normal speakers are used.

Figure 6:
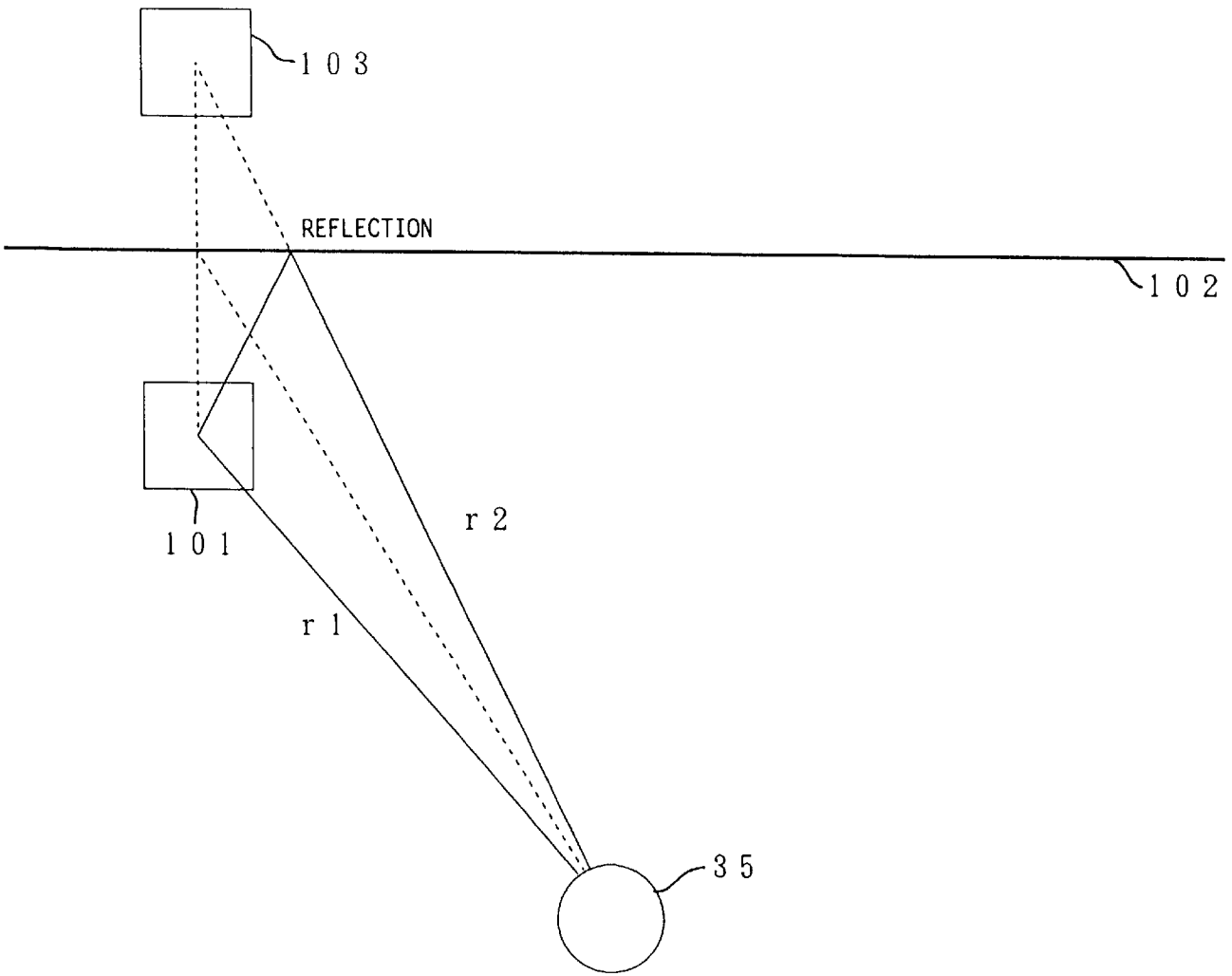
FIG. 6 is a diagram for explaining the baffle effect in a home theater system.

FIG. 6 is a diagram for explaining the baffle effect in the home theater system. When a wall 102 of the listening room exists in a vicinity of a speaker 101, particularly the bass characteristic of the speaker 101 changes because the wall 102 reflects sound. If an infinitely large baffle exists adjacent to the speaker 101, a sound pressure P generated at the position of the listener 35 which is a distance r1 from the speaker 101 changes as shown in the following formula (1) from a sound pressure PO in a free sound field having no baffle, where r2 denotes a distance between the position of the listener 35 and a mirror image 103 of the speaker 101 with respect to a baffle plane.

$$P/PO=\left|1+(r1/r2)e^{-jk(r2-r1)}\right| \quad (1)$$

When the speaker 101 is arranged close to the wall 102 and distance between the listener 35 and the speaker 101 is large compared to the distance between the speaker 101 and the wall 102, the formula (1) described above may be approximated by the following formula (2), and it may be seen that the sound pressure is doubled in the bass region.

$$P/PO \approx 2 \cos (kd \sin \tau) \quad (2)$$

Figure 7:
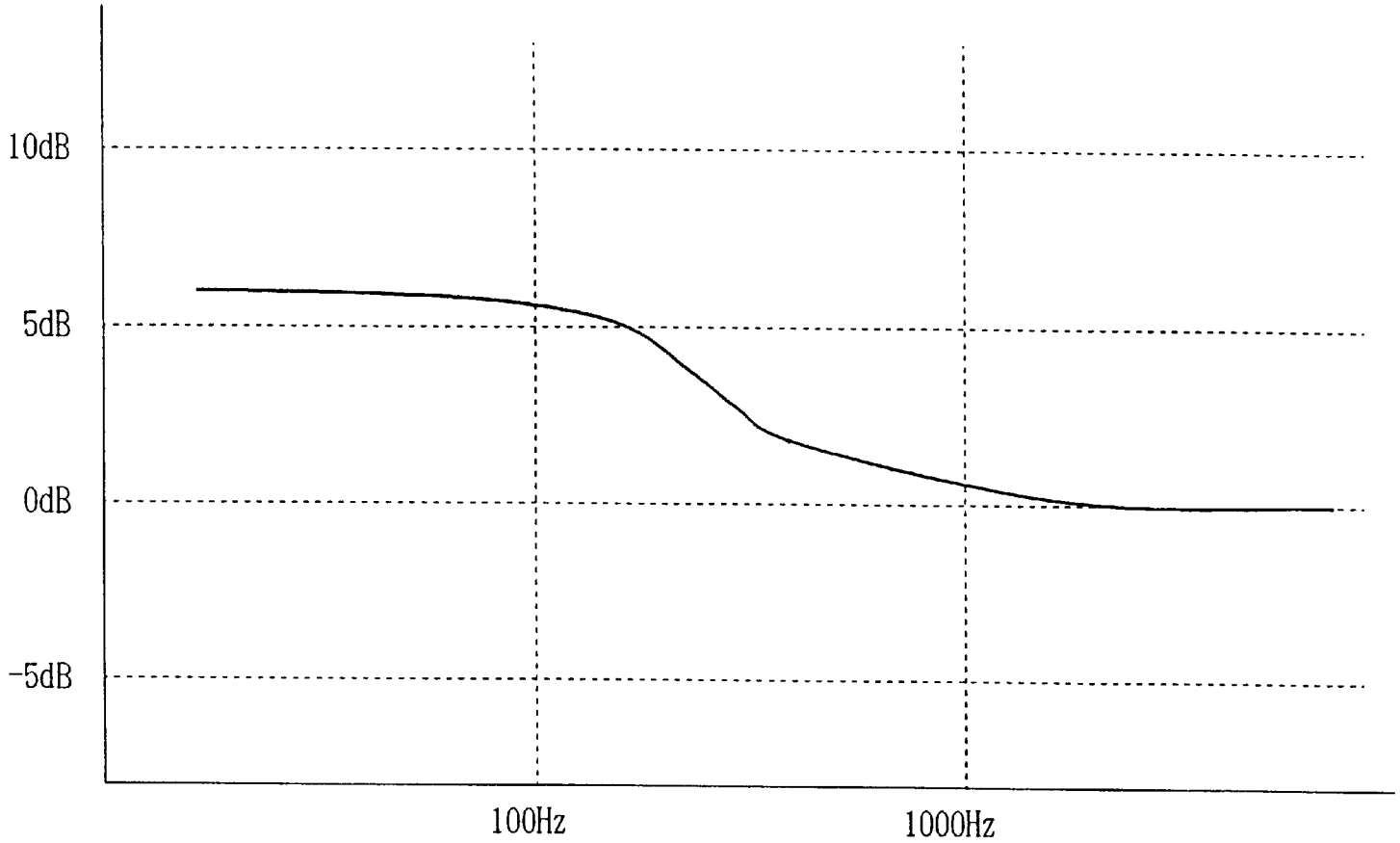
FIG. 7 is a diagram showing a filter characteristic for correcting a frequency characteristic of audio signals.

Therefore, in the third embodiment of the computer system and the third embodiment of the desk-top theater system, a filter which ideally realizes the formula (1) is provided in the sound field correction unit 27 as the frequency characteristic correction means. In other words, the sound field correction unit 27 is formed by a filter or amplifier which emphasizes the audio signal of each channel to approximately 2 times (6 dB) as shown in FIG. 7.

The circuit itself for emphasizing the bass region as described above is known. For this reason, illustration and description related to the bass region emphasizing circuit will be omitted.

In the fourth embodiment of the computer system and the fourth embodiment of the desk-top theater system, the sound field correction unit 27 includes means for correcting differences in reflected sounds caused by different distances separating each of the speakers and the walls of the room.

Figure 8:
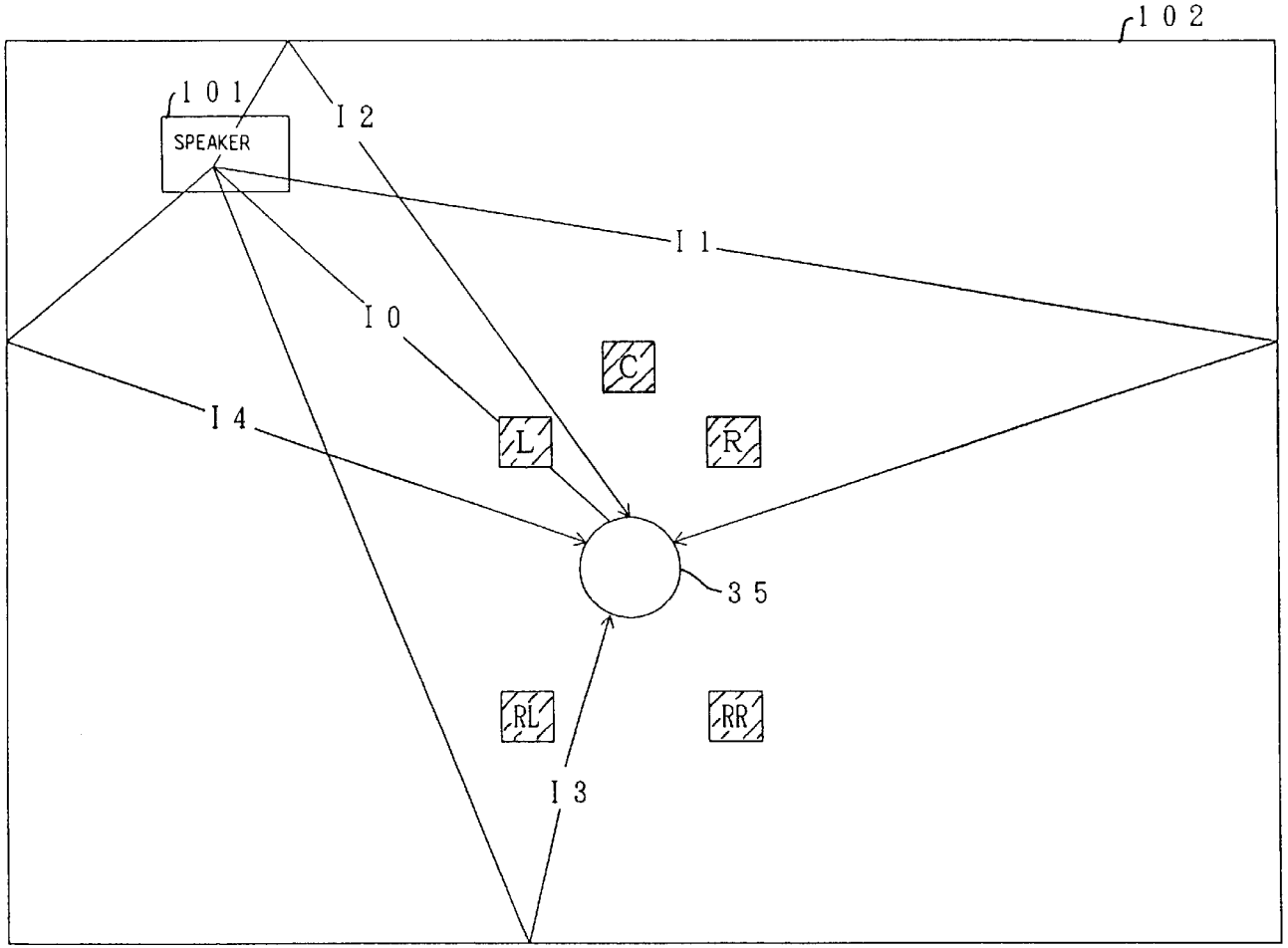
FIG. 8 is a diagram for explaining reverberation at a listener's position in the home theater system.
Figure 9:
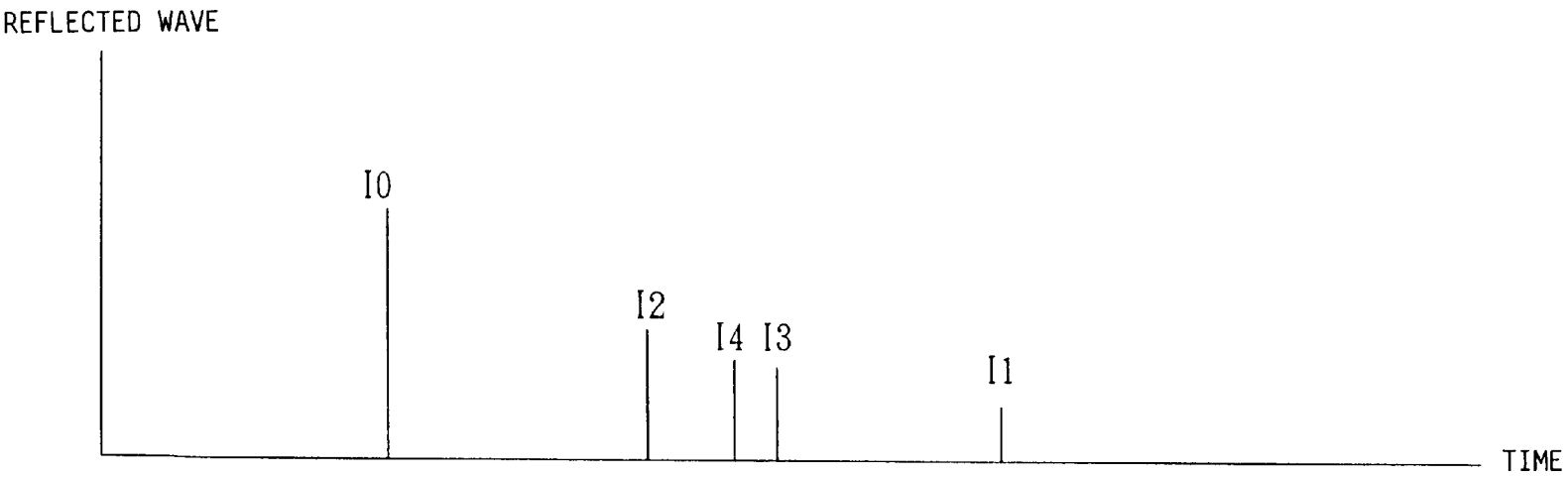
FIG. 9 is a diagram showing the reverberation at the listener's position in the home theater system.

In the general home theater system, the sound output from the speaker 101 is reflected by the walls 102 of the listening room and the reflected sound reaches the listener 35 from various directions as shown in FIG. 8. In FIG. 8, I0 denotes a direct wave, I1 through I4 denote primary (or first order) reflected waves, that is, sound waves reflected once by the wall 102. FIG. 9 is a diagram showing reverberation at the position of the listener 35 in the home theater system shown in FIG. 8. In FIG. 9, the ordinate indicates the reflected wave, and the abscissa indicates the time.

Compared to such a home theater system, the distance between the listener 35 and each of the speakers R, L, C, RR, RL and SB is considerably short in the desk-top theater system 30. For this reason, the time it takes for the direct wave to reach the listener 35 is considerably short in the desk-top theater system 30 as compared to that of the home theater system, and it is thus necessary to delay the time it takes for the direct wave to reach the listener 35 in the desk-top theater system 30. In addition, since each of the speakers R, L, C, RR, RL and SB are driven at a low volume in the desk-top theater system 30, the reflected sound becomes considerably low, and richness of the sound, that is, the reverberation caused by the room, decreases. In this embodiment, the sound field correction unit 27 carries out a reverberation adding process to artificially add the reverberation caused by the room.

More particularly, the reverberation adding process is realized by outputting reflected waves of the sound output from one speaker from other speakers. If a speaker does not exist in the direction of the target reflected wave, the reverberation adding process is realized by outputting from speakers which are located on both sides of the direction of the target reflected wave the sound which has been subjected to a panoramic potentiometer (pan-pot) processing.

Figure 10:
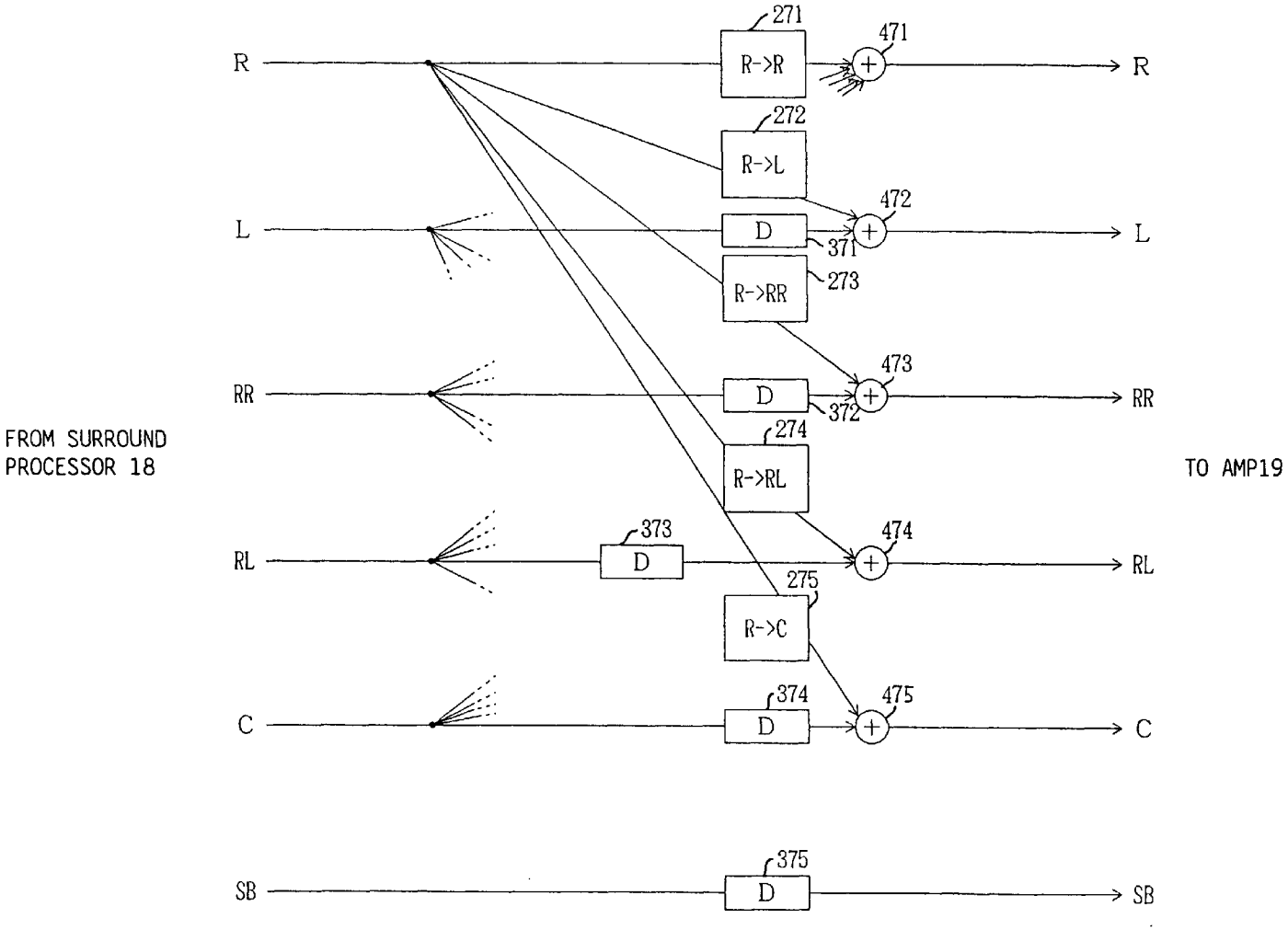
FIG. 10 is a system block diagram showing an embodiment of the construction of a sound field correction unit which makes a reverberation adding process.

FIG. 10 is a system block diagram showing an embodiment of the construction of the sound correction unit 27 which carries out the reverberation adding process. In FIG. 10, the sound field correction unit 27 generally includes reverberation generators 271 through 275, delay circuits 371 through 375, and mixers 471 through 475 which are connected as shown. The delay circuits 371 through 375 respectively have delay times identical to those of the reverberation generators 271 through 275. For the sake of convenience, FIG. 10 shows only the connections for explaining the processing of the audio signal of the channel which is to be supplied to the front right speaker R, but similar connections are of course provided with respect to the audio signals of the channels which are to be supplied to the other speakers L, C, RR, RL and SB.

The audio signal of the channel to be supplied to the front right speaker R is supplied to the mixer 471 via the reverberation generator 271, and is mixed with the audio signals of the channels which are to be supplied to the other channels L, C, RR and RL before being supplied to the front right speaker R. In addition, the audio signal of the channel to be supplied to the front right speaker R is also supplied to the reverberation generators 272 through 275, and output signals of the reverberation generators 272 through 275 are supplied to the corresponding mixers 472 through 475. The mixer 472 mixes the audio signal of the channel which is to be supplied to the front left speaker L and is received via the delay circuit 371 and the output signal of the reverberation generator 272, and an output signal of the mixer 472 is supplied to the front left speaker L. The mixer 473 mixes the audio signal of the channel which is to be supplied to the rear right speaker RR and is received via the delay circuit 372 and the output signal of the reverberation generator 273, and an output signal of the mixer 473 is supplied to the rear right speaker RR. The mixer 474 mixes the audio signal of the channel which is to be supplied to the rear left speaker RL and is received via the delay circuit 373 and the output signal of the reverberation generator 274, and an output signal of the mixer 474 is supplied to the rear left speaker RL. The mixer 475 mixes the audio signal of the channel which is to be supplied to the center speaker C and is received via the delay circuit 374 and the output signal of the reverberation generator 275, and an output signal of the mixer 475 is supplied to the center speaker C. The audio signal of the channel to be supplied to the sub woofer SB is delayed by the delay circuit 375 so as to match its timing with those of the audio signals of the channels subjected to the reverberation adding process, and an output signal of the delay circuit 375 is supplied to the sub woofer SB.

Figures 11A, 11B, 11C:
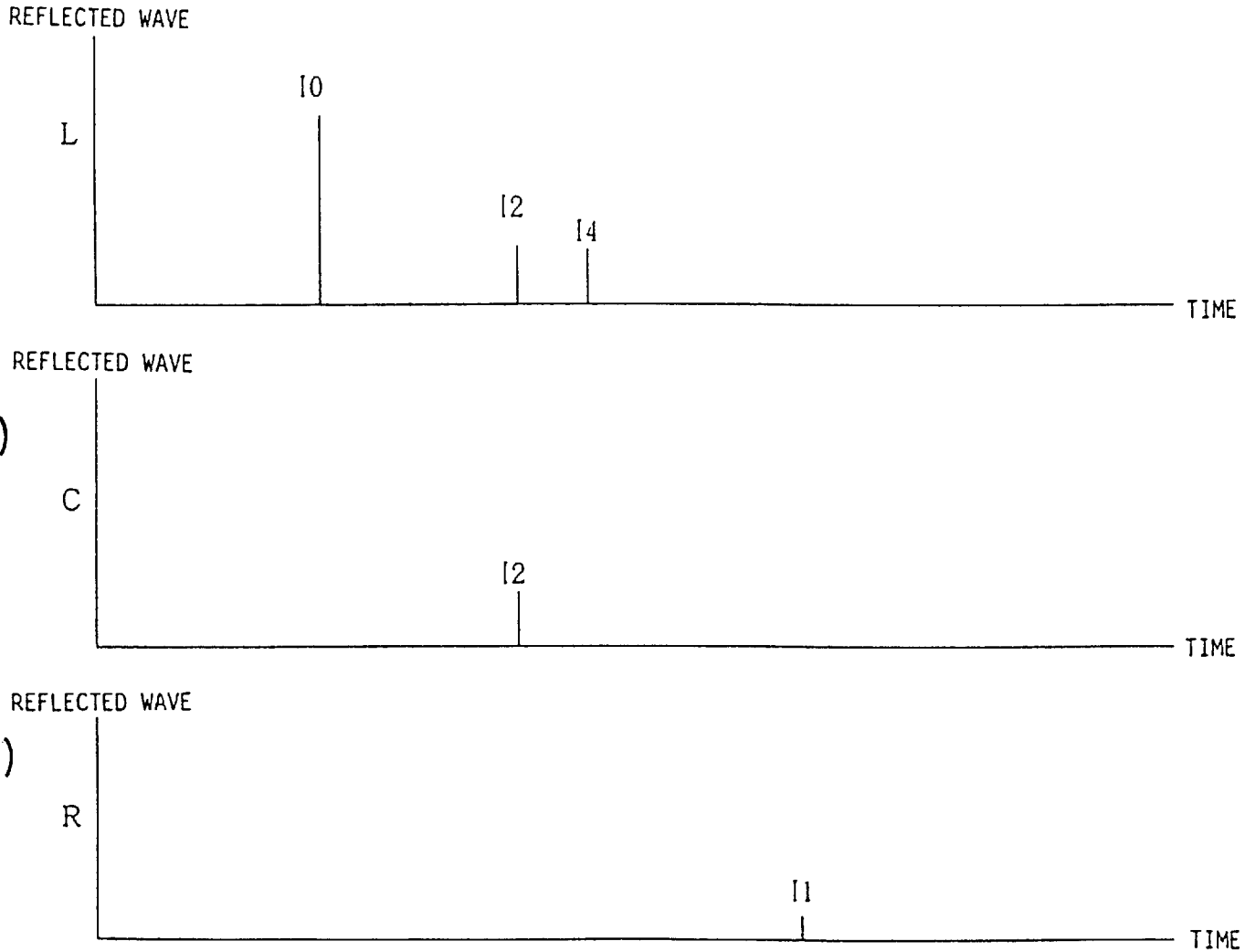
FIGS. 11(*a*)–11(*c*) are diagrams showing impulse responses of reverberation generators when reproducing the reverberation shown in FIG. 9 in the desk-top theater system.
Figure 12A:
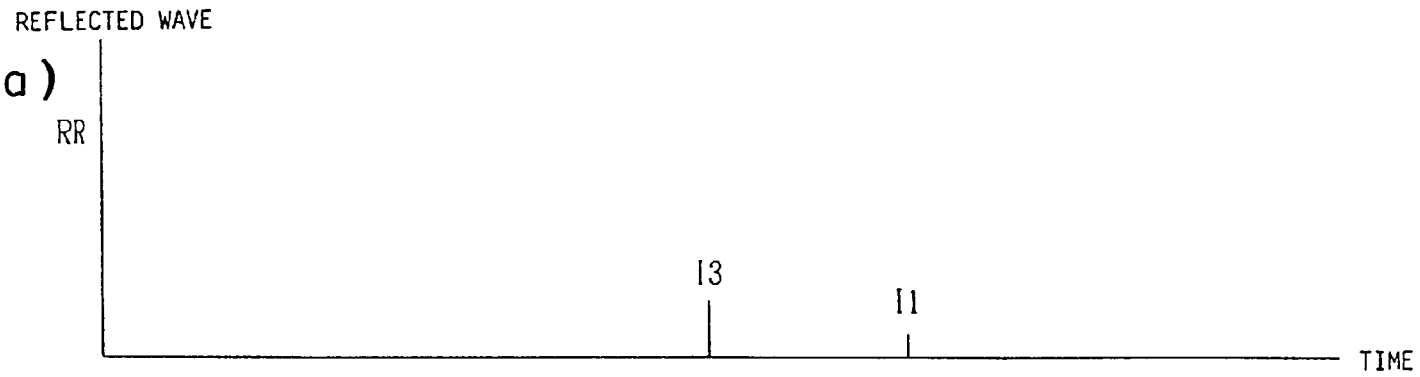
FIGS. 12(*a*) and 12(*b*) are diagrams showing the impulse responses of the reverberation generators when reproducing the reverberation shown in FIG. 9 in the desk-top theater system.
Figure 12B:
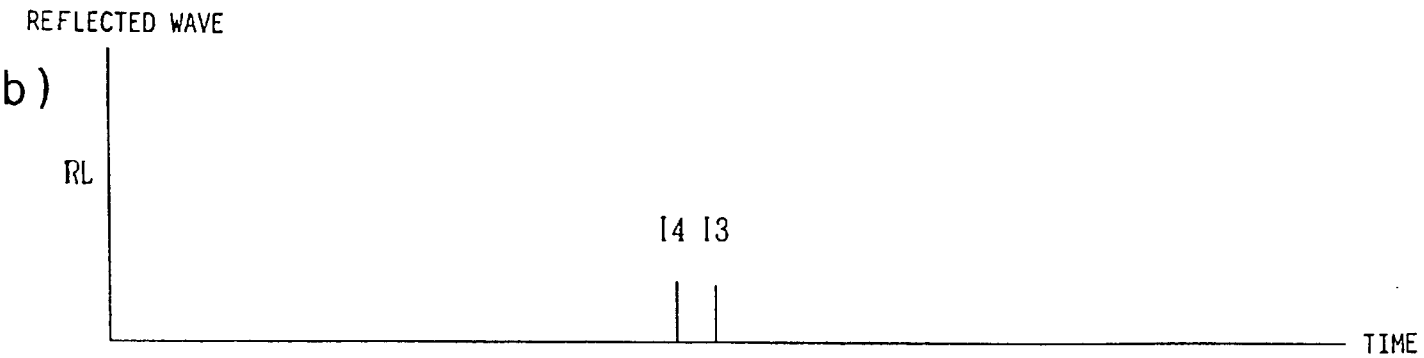

FIGS. 11(*a*)–11(*c*) and 12(*a*)–12(*b*) respectively are diagrams showing impulse responses of the reverberation generators 271 through 275 when reproducing the reverberation shown in FIG. 9 in the desk-top theater system. FIGS. 11(*a*)–11(*c*) and 12(*a*)–12(*b*) show a case where up to the primary reflected wave are treated, and the ordinate indicates the reflected wave and the abscissa indicates the time. FIG. 11(*a*) shows the impulse response of the reverberation generator 272, FIG. 11(*b*) shows the impulse response of the reverberation generator 275, and FIG. 11(*c*) shows the impulse response of the reverberation generator 271. In addition, FIG. 12(*a*) shows the impulse response of the reverberation generator 273, and FIG. 12(*b*) shows the impulse response of the reverberation generator 274. The arrangement of the speakers R, L, C, RR and RL in the desk-top theater system 30 employed in this case is indicated by hatching in FIG. 8.

Figure 13:
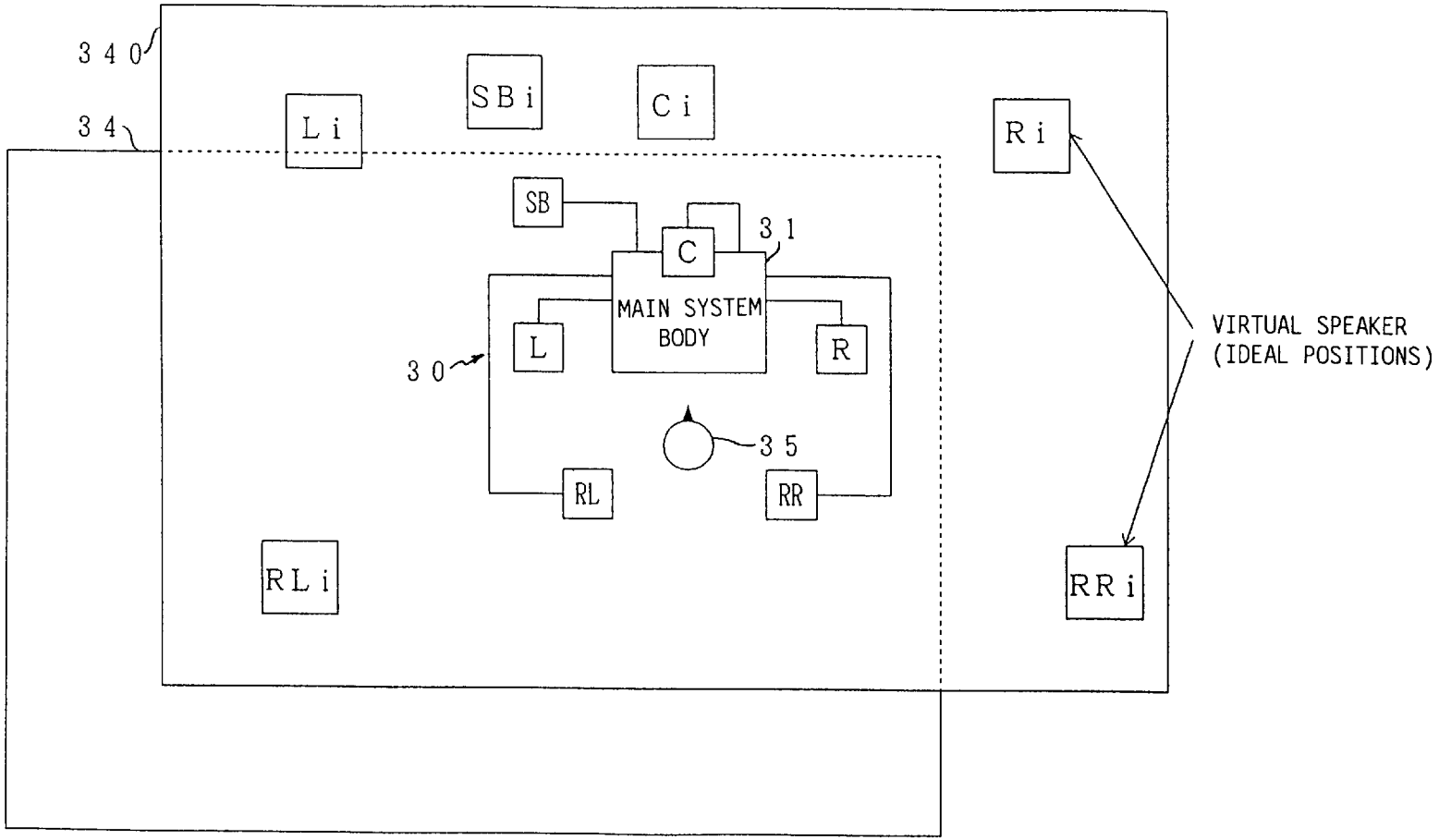
FIG. 13 is a diagram showing a virtual listening room and positions of virtual speakers with respect to the desk-top theater systems.

According to this embodiment, when the desk-top theater system 30 is set up at the rear right corner of the room 34 in FIG. 13, by appropriately setting the impulse responses of the reverberation generators 271 through 275, it is possible to correct the sound field so that the sound reaches the listener 35 as if virtual speakers Ri, Li, Ci, RRi, RLi and SBi are arranged at the positions shown in FIG. 13 within a virtual listening room 340.

Figure 14:
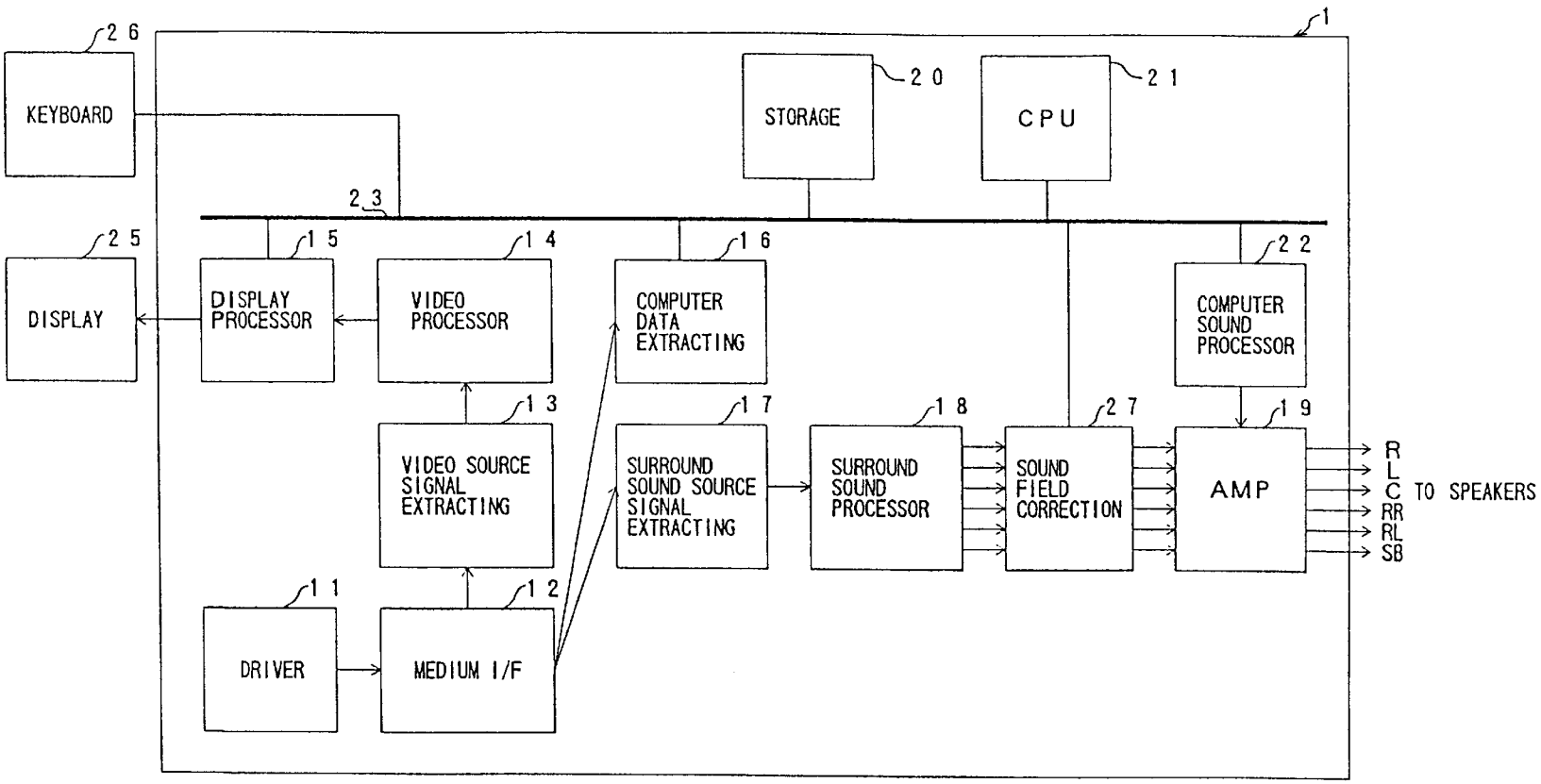
FIG. 14 is a system block diagram showing the construction of a part of a modification of the fourth embodiment of the computer system.

FIG. 14 is a system block diagram showing the construction of a part of a modification of the fourth embodiment of the computer system. In FIG. 14, those parts which are the same as those corresponding parts in FIG. 5 are designated by the same reference numerals, and a description thereof will be omitted. In this modification, the sound field correction unit 27 is connected to the personal computer bus 23.

It is desirable that the impulse responses of the reverberation generators 271 through 275 of the sound field correction unit 27 shown in FIG. 10 are varied depending on the position where the desk-top theater system 30 is set up within the room 34. Hence, in this modification, when the listener 35 inputs from the keyboard 26 information related to the room 34 in which the desk-top theater system 30 is to be set up and information related to the arrangement employed in the desk-top theater system 30, the CPU 21 automatically and appropriately sets the impulse responses of the reverberation generators 271 through 275 based on the input information. As a result, it is possible to realize an extremely good surround sound regardless of the position where the desk-top theater system 30 is set up within the room 34.

Of course, two or more embodiments among the second through fourth embodiments described above may be combined to correct the sound field.

Next, a description will be given of a fifth embodiment of the computer system according to the present invention. In the fifth embodiment of the computer system, the present invention is applied to a personal computer. In addition, the fifth embodiment of the computer system is applied to a fifth embodiment of the desk-top theater system according to the present invention.

Figure 15:
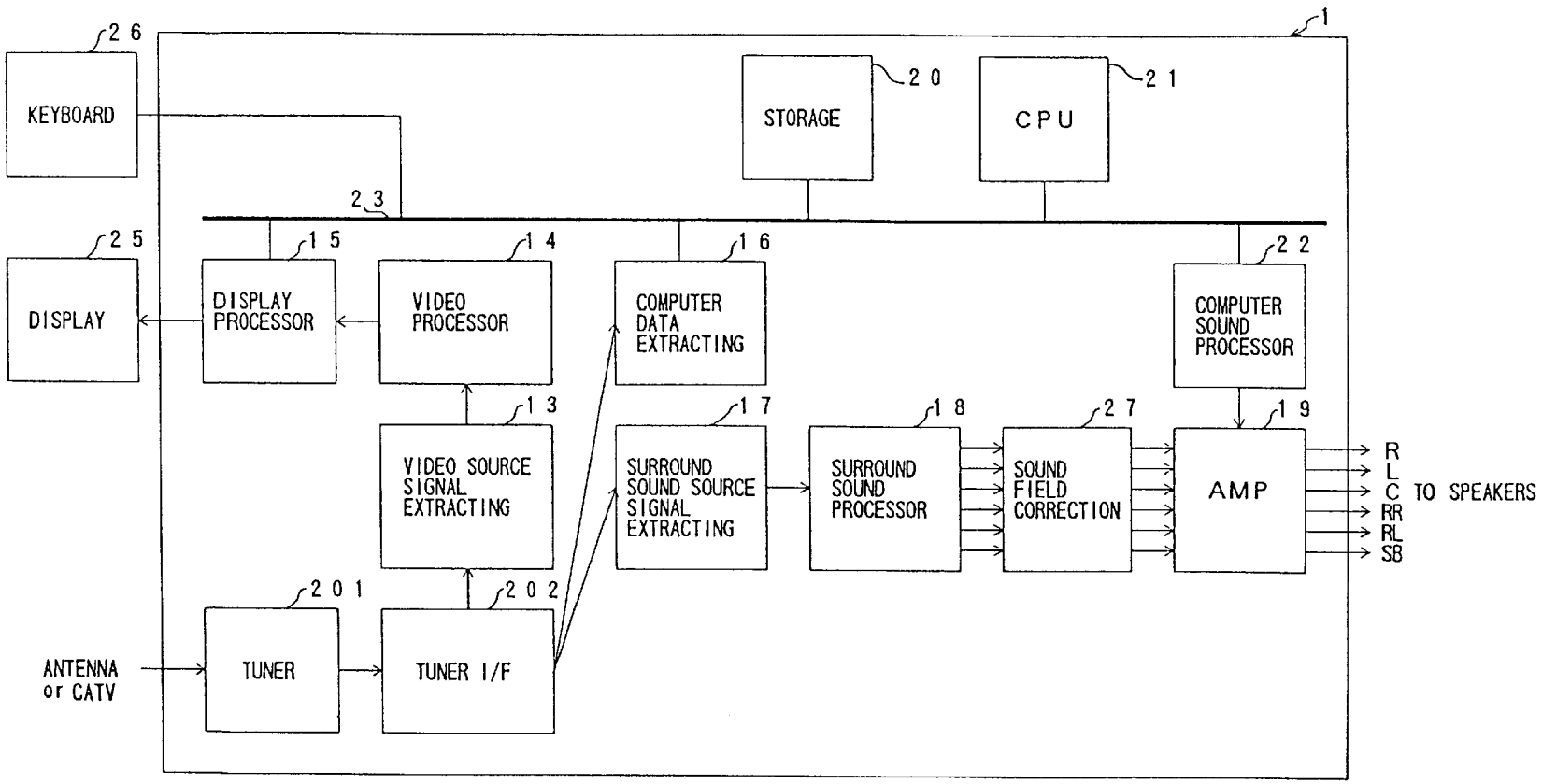
FIG. 15 is a system block diagram showing the construction of a part of a fifth embodiment of the computer system according to the present invention.

FIG. 15 is a system block diagram showing the construction of a part of fifth embodiment of the computer system. In FIG. 15, those parts which are the same as those corresponding parts in FIG. 5 are designated by the same reference numerals, and a description thereof will be omitted.

In this embodiment, a tuner 201 and a tuner interface 202 are provided as shown in FIG. 15 in place of the recording medium driver 11 and the medium interface 12. Data from a broadcast media such as a television broadcast and a radio broadcast are received by the tuner 201 via an antenna or a cable (CATV). The data received by the tuner 201 are supplied to the tuner interface 202 wherein various signals are reproduced. The data from the tuner interface 202 are supplied to the video source signal extraction unit 13, the personal computer data extraction unit 16 and the surround sound source signal extraction unit 17, similar to the first through fourth embodiments described above.

Next, a description will be given of a sixth embodiment of the computer system according to the present invention. In the sixth embodiment of the computer system, the present invention is applied to a personal computer. In addition, the sixth embodiment of the computer system is applied to a sixth embodiment of the desk-top theater system according to the present invention.

Figure 16:
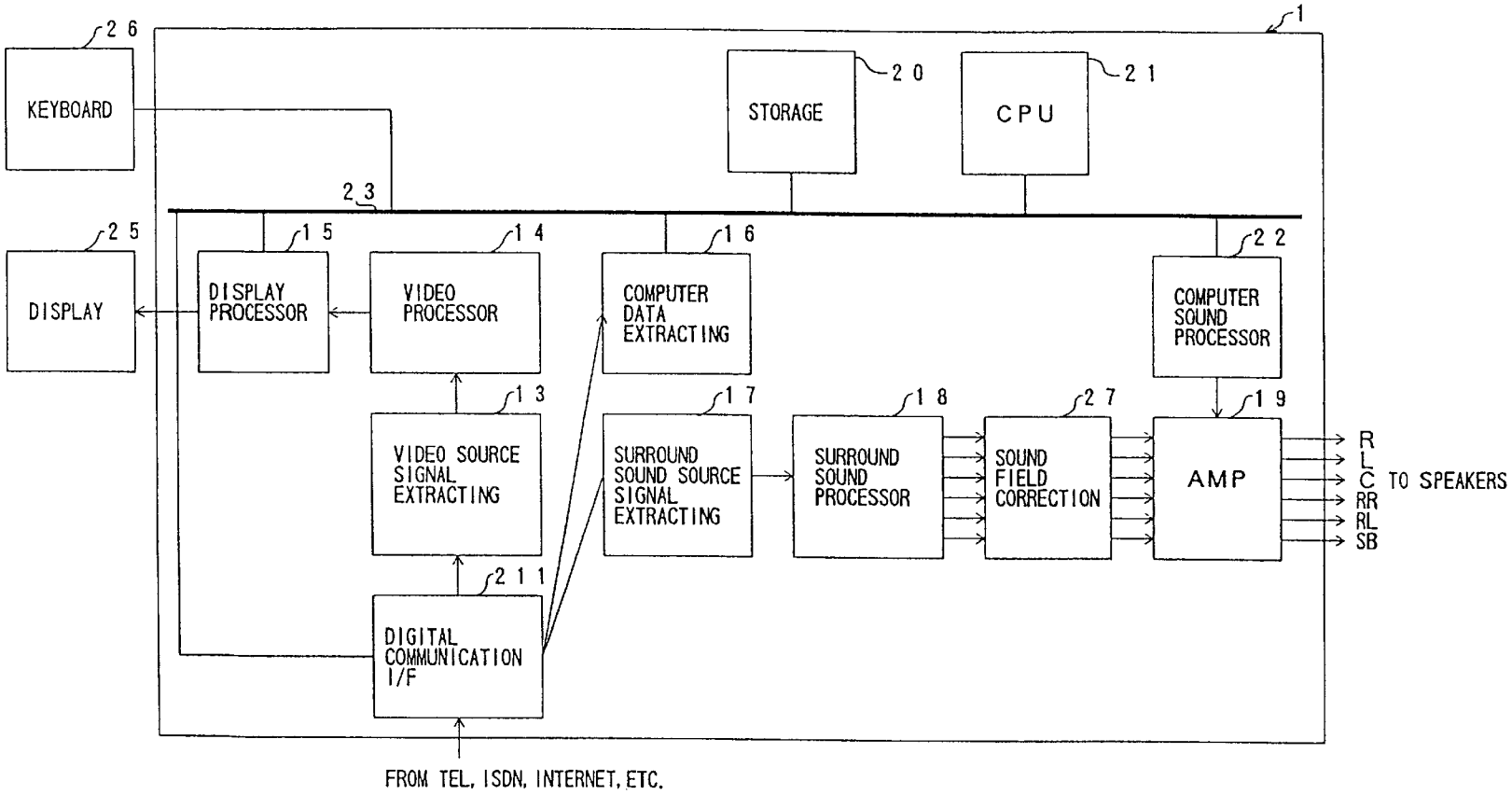
FIG. 16 is a system block diagram showing the construction of a part of a sixth embodiment of the computer system according to the present invention.

FIG. 16 is a system block diagram showing the construction of a part of the sixth embodiment of the computer system. In FIG. 16, those parts which are the same as those corresponding parts in FIG. 5 are designated by the same reference numerals, and a description thereof will be omitted.

In this embodiment, a digital communication interface 211 is provided as shown in FIG. 16 in place of the recording medium driver 11 and the medium interface 12. This digital communication interface 211 is coupled to the personal computer bus 23. Hence, the CPU 21 can judge whether the data being received are from a digital communication media, and the CPU 21 can control the setting of the digital communication interface 211 depending on the judgement result. The data from the digital communication media such as a telephone line network, ISDN and Internet are input to the digital communication interface 211. The data input to the digital communication interface 211 are supplied to the video source signal extraction unit 13, the personal computer data extraction unit 16 and the surround sound source signal extraction unit 17, similar to the first through fourth embodiments described above.

The modification of the first embodiment is also applicable to the second through sixth embodiments and to the modification of the fourth embodiment. In addition, the computer of the computer system is of course within the scope of the present invention.

In addition, each of the embodiments described above use six speakers, however, the number of speakers used is of course not limited to six. More than six speakers may be provided as long as it is possible to reproduce the surround sound.

Further, the present invention is not limited to these embodiments, but various variations and modifications may be made without departing from the scope of the present invention.

What is claimed is:

1. A computer to receive data from a medium and to be operated by a user, comprising:

a processor decoding and converting source signals of surround sound included in the data received via the medium into audio signals having a plurality of channels;

a display unit having a 14 to 17 inch screen;

a plurality of speakers, wherein said plurality of speakers and said display unit are arranged concentrically at a radius of approximately 1.0 to 1.5 m about an operating position of the user operating the computer; and a correction unit within said processor correcting a sound field of the plurality of speakers based on a positional relationship between said speakers, the user, and said display unit, said correction unit performing a reverberation adding process for reflected waves of the source signals.

2. The computer as claimed in claim 1, wherein said correction unit corrects at least one of a volume and a frequency characteristic of the audio signals.

3. The computer as claimed in claim 1, wherein said correction unit carries out a reverberation adding process with respect to the audio signals.

4. The computer as claimed in claim 1, wherein the medium is an information recording medium, broadcasting media, or digital communication media.

5. The computer as claimed in claim 1, further comprising:

an extraction unit extracting the source signals of the surround sound from the data received via the medium.

6. The computer of claim 1, wherein said correction unit performs the reverberation adding process by generating impulse responses for a target reflected wave of the source signal, the impulse responses being generated by outputting the reflected wave generated from one of said speakers through others of said speakers, the reflected wave being output from said speakers located on both sides of the target reflected wave incident on the user if none of said speakers is located in the direction of the target reflected wave.

7. The computer of claim 6, wherein said computer automatically setting the impulse responses based on information input by the user related to arrangement and position of said speakers, said display unit, and walls of a listening room.

8. The computer of claim 1, wherein said correction unit produces a sound field such that the sound reaches the user as if virtual speakers are arranged, within a virtual listening room, at a greater distance from the user than said real speakers.

9. A desk-top theater system to receive data from a medium and to be operated by a user comprising:

a computer system having a main computer body and a display unit having a 14 to 17 inch screen, wherein said main computer body includes a central processing unit and said display unit is coupled to said main computer body; and a plurality of speakers, wherein said plurality of speakers and said display unit are arranged concentrically about an operating position of the user operating the computer system, wherein said main computer body further comprises:

a processor decoding and converting surround sound source signals included in the data received via the medium into audio signals having a plurality of channels said processor including a correction unit correcting a sound field of said plurality of speakers based on a positional relationship between said speakers, the user, and said display unit, said correction unit performing a reverberation adding process for reflected waves of the source signals.

10. The desk-top theater system as claimed in claim 9, wherein said correction unit corrects at least one of a volume and a frequency characteristic of the audio signals.

11. The desk-top theater system as claimed in claim 9, wherein said correction unit carries out a reverberation adding process with respect to the audio signals.

12. The desk-top theater system as claimed in claim 9, wherein the medium is an information recording medium, broadcasting media, or digital communication media.

13. The desk-top theater system as claimed in claim 9, further comprising:

an extraction unit extracting a video source signal to be displayed on said display unit and the surround sound source signals from the data received via the medium.

14. The desk-top theater system of claim 9, wherein said correction unit performs the reverberation adding process by generating impulse responses for a target reflected wave of the source signal, the impulse responses being generated by outputting the reflected wave generated from one of said speakers through others of said speakers, the reflected wave being output from said speakers located on both sides of the target reflected wave incident on the user if none of said speakers is located in the direction of the target reflected wave.

15. The desk-top theater system of claim 14, wherein said computer system automatically setting the impulse responses based on information input by the user related to arrangement and position of said speakers, the display unit, and walls of a listening room.

16. The desk-top theater system of claim 9, wherein said correction unit produces a sound field such that the sound reaches the user as if virtual speakers are arranged, within a virtual listening room, at a greater distance from the user than said real speakers.

17. A method of arranging a display unit which includes a 14 to 17 inch screen and a plurality of computer speakers, comprising the steps of:

arranging said plurality of speakers and said display unit concentrically at a radius of approximately 1.0 to 1.5 m about an operating position of a user operating the computer; and correcting a sound field of the plurality of speakers based on a positional relationship between each of the speakers, the user, and the display unit, said correcting a sound field performing a reverberation adding process for reflected waves of source signals of the sound field.

18. The method of claim 17, wherein said correcting a sound field performs the reverberation adding process by generating impulse responses for a target reflected wave of the source signal, the impulse responses being generated by outputting the reflected wave generated from one of the speakers through others of the speakers, the reflected wave being output from the speakers located on both sides of the target reflected wave incident on the user if none of the speakers is located in the direction of the target reflected wave.

19. The method of claim 18, further comprising automatically setting the impulse responses based on information input by the user related to arrangement and position of the speakers, the display unit, and walls of a listening room.

20. The method of claim 17, wherein said correcting a sound field produces a sound field such that the sound reaches the user as if virtual speakers are arranged, within a virtual listening room, at a greater distance from the user than the real speakers.

21. A computer to receive source signals from a medium and to be operated by a computer operator, comprising:

an audio signal processing system to decode and convert the source signals received from the medium into audio signals having a plurality of channels;

a display unit having a 14 to 17 inch screen; and a plurality of speakers, wherein said plurality of speakers and said display unit are arranged concentrically at a radius of approximately 1.0 to 1.5 m about the computer operator, said audio signal processing system including a correction unit correcting a sound field of the plurality of speakers based on a positional relationship between said speakers, the operator, and said display unit, said correction unit performing a reverberation adding process for reflected waves of the source signals.

22. The computer of claim 21, wherein said correction unit performs the reverberation adding process by generating impulse responses for a target reflected wave of the source signal, the impulse responses being generated by outputting the reflected wave generated from one of said speakers through others of said speakers, the reflected wave being output from said speakers located on both sides of the target reflected wave incident on the operator if none of said speakers is located in the direction of the target reflected wave.

23. The computer of claim 22, wherein said computer automatically setting the impulse responses based on information input by the operator related to arrangement and position of said speakers, said display unit, and walls of a listening room.

24. The computer of claim 21, wherein said correction unit produces a sound field such that the sound reaches the operator as if virtual speakers are arranged, within a virtual listening room, at a greater distance from the user than said real speakers.

25. A computer connectable to a plurality of speakers and a display unit comprising a processor decoding and converting source signals of surround sound included in data received via a medium into audio signals of a plurality of channels, said processor including a correction unit correcting a sound field of the plurality of speakers which are arranged approximately concentrically together with the display unit about an operating position of a user operating the computer, wherein the correction unit corrects the sound field of the plurality of speakers based on a positional relationship between the speakers, the user, and the display unit, said correction unit performing a reverberation adding process for reflected waves of the source signals.

26. The computer as claimed in claim 25, wherein said correction unit corrects at least one of volume and frequency characteristic of the audio signals.

27. The computer as claimed in claim 25, wherein said correction unit carries out a reverberation adding process with respect to the audio signals.

28. The computer as claimed in claim 25, wherein the medium is an information recording medium, broadcasting media or digital communication media.

29. The computer of claim 25, wherein said correction unit performs the reverberation adding process by generating impulse responses for a target reflected wave of the source signal, the impulse responses being generated by outputting the reflected wave generated from one of the speakers through others of the speakers, the reflected wave being output from the speakers located on both sides of the target reflected wave incident on the user if none of the speakers is located in the direction of the target reflected wave.

30. The computer of claim 29, wherein said computer automatically setting the impulse responses based on information input by the user related to arrangement and position of the speakers, the display unit, and walls of a listening room.

31. The computer of claim 25, wherein said correction unit produces a sound field such that the sound reaches the user as if virtual speakers are arranged, within a virtual listening room, at a greater distance from the user than the real speakers.

32. A computer comprising:

a main computer body;

a display unit coupled to said main computer body; and a plurality of speakers arranged approximately concentrically together with said display unit about an operating position of a user operating the computer, said main computer body comprising:

a processor decoding and converting surround sound source signals of surround sound included in data received from a medium into audio signals of a plurality of channels, said processor including a correction unit correcting a sound field of the plurality of speakers based on a positional relationship between the speakers, the user, and said display unit, said correction unit performing a reverberation adding process for reflected waves of the source signals.

33. The computer as claimed in claim 32, wherein said display unit includes a 14 to 17 inch screen, and the speakers and the display unit are arranged concentrically at a radius of approximately 1.0 to 1.5 m about said operating position.

34. The computer of claim 32, wherein said correction unit performs the reverberation adding process by generating impulse responses for a target reflected wave of the source signal, the impulse responses being generated by outputting the reflected wave generated from one of said speakers through others of said speakers, the reflected wave being output from said speakers located on both sides of the target reflected wave incident on the user if none of said speakers is located in the direction of the target reflected wave.

35. The computer of claim 34, wherein said computer automatically setting the impulse responses based on information input by the user related to arrangement and position of said speakers, said display unit, and the walls of the listening room.

36. The computer of claim 32, wherein said correction unit produces a sound field such that the sound reaches the user as if virtual speakers are arranged, within a virtual listening room, at a greater distance from the user than said real speakers.

37. A computer system comprising:

a main computer body including at least a central processing unit; and a display unit coupled to said main computer body, said main computer body comprising:

a processor decoding and converting source signals of surround sound included in data received via a medium into audio signals of a plurality of channels, said processor including a correction unit correcting a sound field of a plurality of speakers arranged approximately concentrically together with said display unit about an operating position of a user operating the computer system, wherein the correction unit corrects the sound field of the plurality of speakers based on a positional relationship between each of the plurality of speakers, the user, and said display unit, said correction unit performing a reverberation adding process for reflected waves of the source signals.

38. The computer system of claim 37, wherein said correction unit performs the reverberation adding process by generating impulse responses for a target reflected wave of the source signal, the impulse responses being generated by outputting the reflected wave generated from one of the speakers through others of the speakers, the reflected wave being output from the speakers located on both sides of the target reflected wave incident on the user if none of the speakers is located in the direction of the target reflected wave.

39. The computer system of claim 38, wherein said computer system automatically setting the impulse responses based on information input by the user related to arrangement and position of the speakers, said display unit, and walls of a listening room.

40. The computer of claim 37, wherein said correction unit produces a sound field such that the sound reaches the user as if virtual speakers are arranged, within a virtual listening room, at a greater distance from the user than the real speakers.

41. A computer comprising:

a processor including a correction unit correcting a sound field of a plurality of speakers which are arranged approximately concentrically together with a display unit about an operating position of a user operating the computer, wherein the correction unit corrects the sound field of the plurality of speakers based on a positional relationship between the speakers, the user, and the display unit, said correction unit performing a reverberation adding process for reflected waves of source signals of the sound field.

42. The computer of claim 41, wherein said correction unit performs the reverberation adding process by generating impulse responses for a target reflected wave of the source signal, the impulse responses being generated by outputting the reflected wave generated from one of the speakers through others of the speakers, the reflected wave being output from the speakers located on both sides of the target reflected wave incident on the user if none of the speakers is located in the direction of the target reflected wave.

43. The computer of claim 42, wherein said computer automatically setting the impulse responses based on information input by the user related to arrangement and position of the speakers, the display unit, and the walls of the listening room.

44. The computer of claim 41, wherein said correction unit produces a sound field such that the sound reaches the user as if virtual speakers are arranged, within a virtual listening room, at a greater distance from the user than the real speakers.

* * * * *